United States Patent [19]

Beal

[11] 3,963,123

[45] June 15, 1976

[54] CARDED HARDWARE ARTICLE PACKAGE

[75] Inventor: Glenn I. Beal, Somerset, Pa.

[73] Assignee: R. M. Smith, Inc., Somerset, Pa.

[22] Filed: Mar. 20, 1974

[21] Appl. No.: 453,100

[52] U.S. Cl. ..... 206/495; 24/73 PF; 206/45.14; 206/477; 206/480; 206/493; 248/75

[51] Int. Cl.[2] ..... B65D 73/00

[58] Field of Search ..... 206/477, 45.14, 481, 206/478, 480, 495, 349, 493; 248/27, 74 PB, 75, 74 R, 78; 24/73 BR, 73 PF

[56] References Cited

UNITED STATES PATENTS

| | | | |
|---|---|---|---|
| 1,953,062 | 4/1934 | Conway | 206/349 |
| 2,937,834 | 5/1960 | Orenick et al. | 248/74 PB |
| 3,159,365 | 12/1964 | Watson | 206/477 |
| 3,380,581 | 4/1968 | Landgraf | 206/493 |
| 3,674,138 | 7/1972 | Gilmour | 206/349 |

*Primary Examiner*—George E. Lowrance
*Assistant Examiner*—Bruce H. Bernstein
*Attorney, Agent, or Firm*—Cushman, Darby & Cushman

[57] ABSTRACT

A package is disclosed which comprises a hose nozzle, sprinkler head spike base, or the like, mounted on a shipping/display card. The hose nozzle, sprinkler head spike base, or the like has two holes formed in portions thereof for receiving fasteners. The holes may be formed in a plate which is part of the article, or they may be formed in web portions formed on the article specifically for mounting. The fastener includes a cylindrical portion for engagement with said holes and an enlarged head engaging the side of said card opposite the side on which said article is mounted, or alternatively a rivet member with two flexible cam-supporting legs, each insertable through one hole.

5 Claims, 5 Drawing Figures

CARDED HARDWARE ARTICLE PACKAGE

SUMMARY OF THE INVENTION

This invention relates to packages and more particularly to packages comprising a hose nozzle, sprinkler head spike base, hose shut-off valve or the like, and a card, and having improved means for effecting the securement of the card and hose nozzle, spike base, or the like together.

It is desirable to form individual packages of hardware articles, such as hose nozzles, by securing such articles to a card. This card package permits the article to be conveniently shipped in cartons and to be displayed for sale either within the shipping carton or on display peg racks.

My U.S. Pat. No. 3,674,138, issued July 4, 1972, shows a hose nozzle - card package with means for securing the hose nozzle to the card. The present invention is an improvement of this package.

An object of the present invention is the provision of a carded package of the type described having improved means for securing the hose nozzle, sprinkler head spike base, hose shut-off valve or the like, to the card which insures that the package is maintained in assembled relation even when subjected to severe handling.

Another object of the present invention is the provision of a carded package of the type described having improved means for securing the article and card together which is simple but effective in operation and economical to manufacture.

Another object of the present invention is the provision of a carded package that will be maintained in assembled relation even for heavy hardware articles without the need for tabs or cutouts formed from or in the card itself.

These and other objects of the present invention will become more apparent during the course of the following detailed description and appended claims.

DETAILED DESCRIPTION OF THE INVENTION

Figure 1:
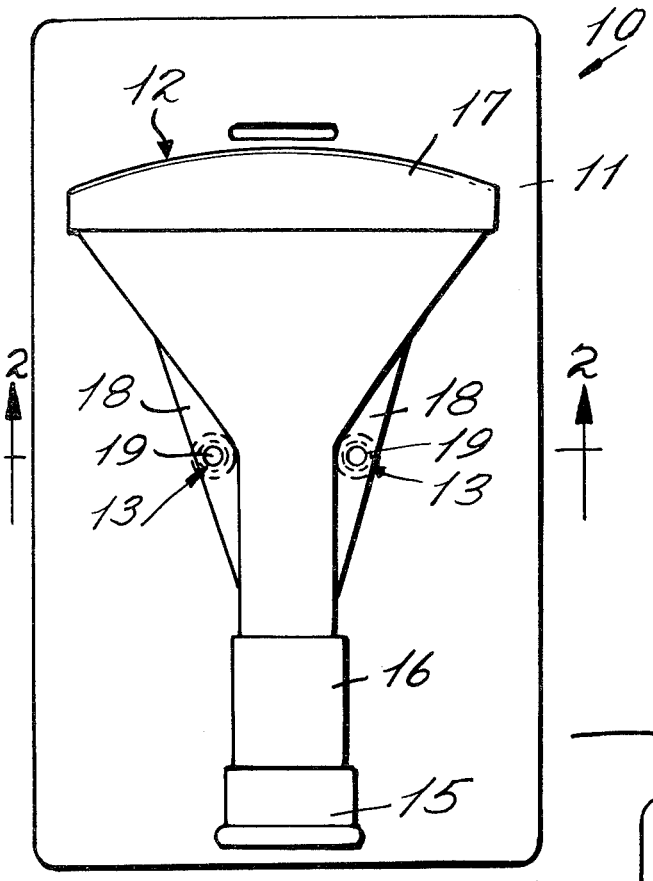
FIG. 1 is a front elevational view of the package embodying the principles of the present invention.
Figure 2:
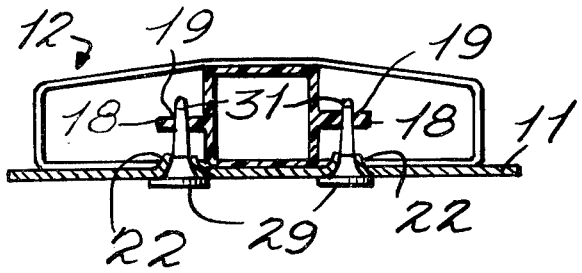
FIG. 2 is a partial cross-sectional view taken along lines 2—2 of FIG. 1.

Referring now more particularly to the drawings, there is shown in FIGS. 1 and 2 thereof a package, generally indicated at 10, embodying the principles of the present invention. The package 10 comprises a card 11, a hose nozzle, generally indicated at 12, and fastening means, generally indicated at 13, for securing the nozzle and card together.

The nozzle 12 includes a main body portion 16, a socket portion 15 which is interiorly threaded to receive a male hose fitting, a head 17, and web portions 18 having holes 19 therein for receipt of fastening means.

Figure 3A:
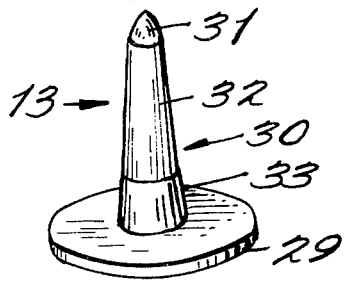
FIGS. 3*a* and 3*b* are perspective views of preferred forms of fasteners utilized in the package of the present invention.

As best shown in FIGS. 2 and 3a, the fasteners 13 are preferably molded of any suitable plastic and include an enlarged circular relatively flat head 29 and a shank structure, generally indicated at 30, extending centrally from one surface of the head. Preferably the shank structure 30 includes a frustoconical portion 33 adjacent the head 29, a generally conical tip portion 31 at the free end thereof, and a generally cylindrical aperture engaging central portion 32. The individual fastener is clearly disclosed in my above-mentioned U.S. Pat. No. 3,674,138.

As is shown in FIG. 2, the nozzle 12 is connected to card 11 by passing tip portions 31 and central portions 32 through cards 11 (as through preformed holes 22), and through holes 19 in webs 18 of nozzle 12. The snug fit engagement of the cylindrical portions 32 of the fasteners 13 within the apertures 19 in webs 18, and the engagement of the relatively large heads 29 of the fasteners with the surface of the card 11 opposite to the surface on which the nozzle is mounted, serve to provide an exceptionally effective connection between the nozzle and the card which will prevent disassembly even under severe handling conditions.

It will be understood that the nozzle, card and fastener may be assembled manually or by use of appropriate assembly machinery. Disassembly is easily accomplished, however, by utilizing a screwdriver or the like and prying the fastener out of its engagement with the apertures 19.

This securement is particularly effective because the fasteners engage rigid portions of the main nozzle at positions which are located generally near the center of gravity of the nozzle, and are spaced on opposite sides of an axis of rotation of the nozzle so that rotation of the nozzle relative to the card is not possible. Thus, the present invention does not require tabs or cutouts of the card 11 to restrain the nozzle against rotational movement, and maintains assembly of even heavy hardware articles with the card.

Figure 3B:
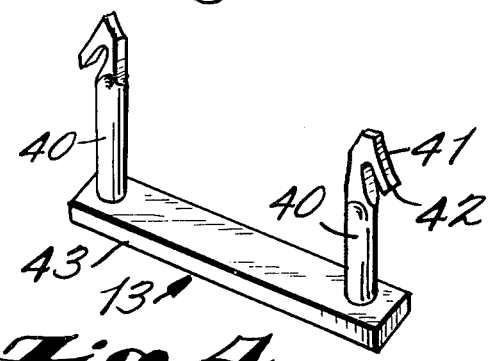

A modified form of a fastener that could be used in practicing the teachings of the present invention is shown at 13′ in FIG. 3*b*. The fastener 13′ is a rivet member preferably molded of plastic having a cross-portion 43 joining two flexible legs 40. Each flexible leg 40 has a camming portion 41 and a locking portion 42 at the free end thereof. When fastening an article according to the teachings of the present invention, legs 40 of fastener 13′ are inserted through holes 22 in card 11 and through apertures 19 in webs 18 (either on a nozzle or hose shutoff valve or the like). The surface of webs 18 bordering on apertures 19 will cam camming portions 41 and legs 40 to allow them to pass through apertures 19. Upon passage through apertures 19 the camming portions 41 and legs 40 will return to their normal positions, thereby causing locking portions 42 to engage the top (as orientated in FIG. 2) surfaces of webs 18. Cross-portion 43 will engage the surface of card 11 opposite the surface on which the article is mounted. Disassembly can be effected by bending (as with a tool) camming portions 41 of legs 40 so that they can be forced back through apertures 19.

Figure 4:
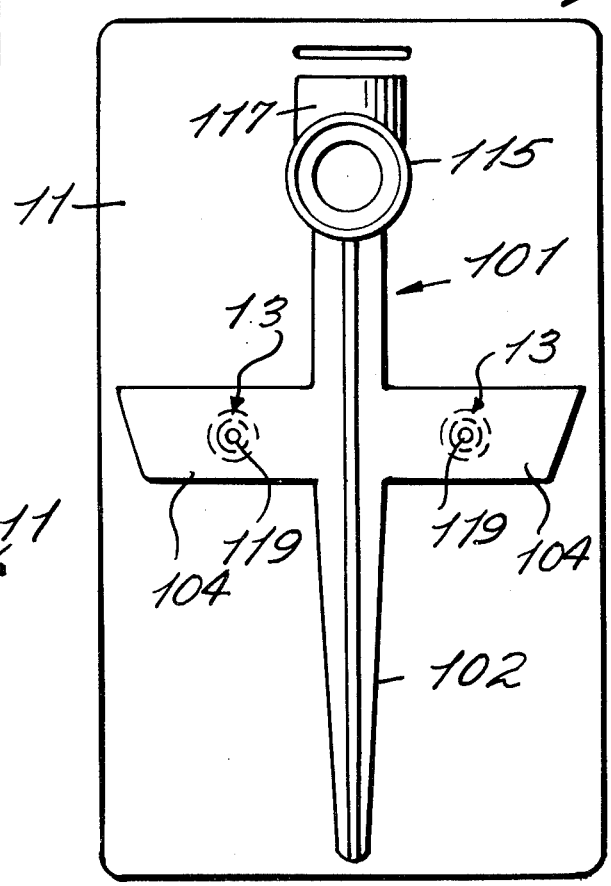
FIG. 4 is a front elevational view of another embodiment of the present invention.

FIG. 4 shows a modified package according to the present invention indicated generally at 110. Here, a sprinkler head spike base, indicated generally at 101, to be mounted on a card 11 includes a socket portion 115 that is interiorly threaded to receive a male hose fitting, a sprinkler head receiving portion 117 that is interiorly threaded to receive a male connection of a sprinkler head, a stake portion 102, and two integrally formed plate cross-portions 104 for assisting driving the spike portion 102 into the ground. The cross-portions 104 contain holes 119 therein for receiving fastening means 13. Again, the holes 119 are located near the center of gravity of the article for firm securement and are spaced to prevent rotation of the article relative to the card.

It will thus be seen that means are provided for firmly holding even heavy articles in place on a shipping/display card without relying on card cutouts and tabs. All of the objects of this invention have been fully and effectively accomplished. Although the invention has been herein shown and described in what is conceived to be the most practical and preferred embodiments, it is recognized that departures may be made therefrom within the scope of the invention which is not to be limited to details disclosed but is to be accorded the full scope of the claims so as to embrace any and all equivalent structures and devices.

What I claim is:

1. A package comprising:

a. a sprinkler component article, said article having an axis of rotation, and said article being generally symmetrical about a center plane passing through the center of said article and the axis of rotation thereof and having a water-receiving socket bisected by said center plane, and said article including a body having a pair of spaced-apart plate portions thereof, one located on each side of said center plane, and said plate portions each having an aperture extending therethrough, said apertures being located near the center of gravity of said article, being specially formed for mounting of said article on a card, and being disposed on opposite sides of the axis of rotation of said article, b. a display card of an area greater than the outline configuration of said article receiving said article on one surface thereof with said plate portions disposed in spaced parallel relation thereto, and c. fastening means for fastening said article to said card, said fastening means comprising a fastener shank extending through each aperture, said fastener shanks being engaged through said card, and enlarged generally flat head means integral with each fastener shank, said head means engaging the surface of said card opposite the surface thereof receiving said article, said fastening means securely holding said article to said card and preventing rotation of said article relative to said card.

2. A package as recited in claim 1 wherein said spaced plate portions of said article are integral webs formed specially on said article for allowing fastening of said article to said card.

3. A package as recited in claim 1 wherein said spaced plate portions of said article are otherwise functional integral plates of said article.

4. A package as recited in claim 1 wherein each said shank of said fastening means frictionally engages the borders of said corresponding plate portions forming said apertures therein.

5. A package as recited in claim 1 wherein said fastening means include a cam portion and a locking portion on the end of each of said shanks remote from said head means, each said locking portion engaging the plate surface of said corresponding plate portion remote from said card, and wherein said head means includes an elongated head portion attaching said two shanks together, and wherein each said locking portion includes a free end of the shank to which it is connected, said free ends of said two shanks being generally turned downwardly generally back toward said head means.

* * * * *